US009450300B2

(12) United States Patent
Yemelong

(10) Patent No.: US 9,450,300 B2
(45) Date of Patent: Sep. 20, 2016

(54) SPIRAL ANTENNA FOR DISTRIBUTED WIRELESS COMMUNICATIONS SYSTEMS

(71) Applicant: 3M INNOVATIVE PROPERTIES COMPANY, St. Paul, MN (US)

(72) Inventor: Constand E. Yemelong, Austin, TX (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 172 days.

(21) Appl. No.: 14/063,271

(22) Filed: Oct. 25, 2013

(65) Prior Publication Data

US 2014/0132479 A1 May 15, 2014

Related U.S. Application Data

(60) Provisional application No. 61/726,632, filed on Nov. 15, 2012.

(51) Int. Cl.

| | |
|---|---|
| ***H01Q 1/36*** | (2006.01) |
| ***H01Q 1/38*** | (2006.01) |
| ***H01Q 1/00*** | (2006.01) |
| ***H01Q 1/27*** | (2006.01) |

(52) U.S. Cl.

CPC ..... *H01Q 1/38* (2013.01); *H01Q 1/007* (2013.01); *H01Q 1/27* (2013.01); *H01Q 1/36* (2013.01)

(58) Field of Classification Search

CPC ..... H01Q 1/36; H01Q 1/38
USPC ..... 343/895, 792.5
See application file for complete search history.

(56) References Cited

U.S. PATENT DOCUMENTS

| | | | | |
|---|---|---|---|---|
| 4,525,720 | A | 6/1985 | Corzine | |
| 4,658,262 | A | 4/1987 | DuHamel | |
| 5,146,234 | A * | 9/1992 | Lalezari | H01Q 1/36 343/859 |
| 5,453,752 | A | 9/1995 | Wang | |
| 5,621,422 | A * | 4/1997 | Wang | H01Q 1/36 343/700 MS |
| 5,815,122 | A | 9/1998 | Nurnberger | |
| 6,563,465 | B2 | 5/2003 | Frecska | |

(Continued)

FOREIGN PATENT DOCUMENTS

JP 2004-364040 A 12/2004

OTHER PUBLICATIONS

International Search Report for PCT/US2013/066814, mailed on Feb. 18, 2014, 3 pp.

(Continued)

*Primary Examiner* — Dameon E Levi
*Assistant Examiner* — Hasan Islam
(74) *Attorney, Agent, or Firm* — Gregg H. Rosenblatt

(57) ABSTRACT

An antenna for wireless communication comprises a dielectric substrate having a first side and an opposite second side. A first major arm having a first modified log-spiral spiral pattern is disposed on the first side of the dielectric substrate. A second major arm having a second modified log-spiral pattern is disposed on the second side of the dielectric substrate, wherein the first and second major arms are formed from a conductive material. A connector coupling is disposed at a center of the modified log-spiral patterns, the connector coupling having a first portion coupled to the first major arm and a second portion coupled to the second major arm. The antenna is self-complementary. The antenna can achieve a return loss better than 10 dB over a broadband range.

14 Claims, 10 Drawing Sheets

(56) References Cited

U.S. PATENT DOCUMENTS

| | | | | |
|---|---|---|---|---|
| 6,750,828 | B1 * | 6/2004 | Wixforth | H01Q 1/3275 343/853 |
| 6,791,497 | B2 | 9/2004 | Winebrand | |
| 7,646,348 | B2 | 1/2010 | Huang | |
| 7,692,603 | B1 | 4/2010 | Cencich, Sr. | |
| 7,750,861 | B2 * | 7/2010 | Delgado | H01Q 9/27 343/701 |
| 7,764,236 | B2 * | 7/2010 | Hill | H01Q 1/243 343/702 |
| 8,552,922 | B2 * | 10/2013 | Igwe | H01Q 9/27 343/705 |
| 8,704,728 | B2 * | 4/2014 | Mujahed | G01C 21/005 343/895 |
| 2009/0267859 | A1 | 10/2009 | Koh | |
| 2009/0324188 | A1 | 12/2009 | Berglund | |
| 2010/0243096 | A1 | 9/2010 | Berglund | |
| 2011/0030832 | A1 | 2/2011 | Larson | |
| 2012/0229363 | A1 | 9/2012 | Webb | |
| 2012/0292076 | A1 | 11/2012 | Shoemaker | |
| 2012/0293390 | A1 | 11/2012 | Shoemaker | |
| 2012/0295486 | A1 | 11/2012 | Petersen | |

OTHER PUBLICATIONS

Thaysen, J., et al., "Characterisation and optimisation of a coplanar waveguide fed logarithmic spiral antenna", 2000 *IEEE Conference on Antennas and Propagation for Wireless Communications*, Nov. 6-8, 2000 (Jan. 1, 2000); pp. 25-28.

Supplementary EP Search Report for 13854653.6, mailed on Jun. 7, 2016, 4 pp.

* cited by examiner

SPIRAL ANTENNA FOR DISTRIBUTED WIRELESS COMMUNICATIONS SYSTEMS

CROSS REFERENCE TO RELATED APPLICATION

This application claims the benefit of U.S. Provisional Patent Application No. 61/726,632, filed Nov. 15, 2012, the disclosure of which is incorporated by reference herein in its entirety.

BACKGROUND OF THE INVENTION

1. Field of the Invention

The present invention is directed to an antenna for distributed wireless communications systems. More particularly, the antenna is configured as a modified log-spiral antenna and can be utilized in a network that provides in-building wireless (IBW) communications.

2. Background

Several hundred million multiple dwelling units (MDUs) exist globally, which are inhabited by about one third of the world's population. Better wireless communication coverage is needed to provide the desired bandwidth to an increasing number of customers. Thus, in addition to new deployments of traditional, large "macro" cell sites, there is a need to expand the number of "micro" cell sites (sites within structures, such as office buildings, schools, hospitals, and residential units). In-Building Wireless (IBW) Distributed Antenna Systems (DASs) are utilized to improve wireless coverage within buildings and related structures. Conventional DASs use strategically placed antennas or leaky coaxial cable (leaky coax) throughout a building to accommodate radio frequency (RF) signals in the 400 MHz to 6 GHz frequency range.

In recent years, consumers have demanded high rates from mobiles devices. Emerging high speed cellular and wireless technologies such as 3G, WiMax, WiFi, and LTE have promised and are delivering mobile broadband wireless connectivity. As a result, consumers are substituting landlines for mobile phones, and are expecting uninterrupted coverage from the wireless services providers. Since more than half of all mobile communications now originate from inside building, the way wireless services providers plan their networks for coverage and capacity is rapidly changing. The increase in data rate with finite transmit power will lead to cells with smaller radii. This trend will lead to a rapid development and deployment of Distributed Antenna Systems (DAS), both indoors and outdoors.

A large part of the deployment cost for an indoor DAS for an IBW system is the labor to install and upgrade the wireless cabling and hardware. Thus, a need exists for a low cost and easy to install and upgrade structured cabling transmission system. Located below the ceiling, the structured cabling system will distribute wired (via an enterprise grade Passive Optical Network (PON)) and wireless signals (Cellular, PCS, Telemetry, WiFi, Public Safety). One such system is described in co-pending US Publication Nos. 2012-0293390 and 2012-0295486. Key components of this structured cabling system include broadband antennas that are easily attached to the structured cabling solution; either directly to the cable or to the remote radio unit. Current IBW DAS deployment employs multiple discrete antennas whereby one antenna is used for each service: one antenna for Public Safety, one antenna for WiFi, and so on.

Physical and aesthetic challenges exist in providing IBW cabling for different wireless network architectures, especially in older buildings and structures. These challenges include gaining building access, limited distribution space in riser closets, and space for cable routing and management.

Outside the United States, carriers are required by law in some countries to extend wireless coverage inside buildings. In the United States, bandwidth demands and safety concerns will drive IBW applications, particularly as the world moves to current 4G architectures and beyond.

SUMMARY

According to an exemplary aspect of the present invention, an antenna for wireless communication comprises a dielectric substrate having a first side and an opposite second side. A first major arm having a first modified log-spiral spiral pattern is disposed on the first side of the dielectric substrate. A second major arm having a second modified log-spiral pattern is disposed on the second side of the dielectric substrate, wherein the first and second major arms are formed from a conductive material. A connector coupling is disposed at a center of the modified log-spiral patterns, the connector coupling having a first portion coupled to the first major arm and a second portion coupled to the second major arm. The antenna is self-complementary.

In another aspect, the antenna has scale invariance.

In another aspect, the first major arm is formed from a combination of first and second minor arms each having a log-spiral pattern shape and each having the same area. In a further aspect, the second minor arm is oriented such that it is rotated about 112 degrees from a position 180 degrees from the first minor arm. In another aspect, the second major arm is formed from a combination of first and second minor arms each having a log spiral pattern shape and each having the same area, wherein the second minor arm is oriented such that it is rotated about 112 degrees from a position 180 degrees from the first minor arm. In a further aspect, the first and second minor arms each include a semi-circular end cap formed on an end portion thereof.

In another aspect, the antenna has a bandwidth extending from about 500 MHz to about 10 GHz. In another aspect, the antenna has a bandwidth extending from about 700 MHz to about 6 GHz.

In another aspect, the connector coupling includes a coaxial receptacle having a main body mounting portion mountable to one of major arms and a center pin configured to pass through the dielectric substrate and connect to the other major arm.

In another aspect, the antenna has an impedance of 50 ohms.

In another aspect, the first and second major arms are substantially non-overlapping.

In another aspect, the antenna further includes a housing to support the dielectric substrate, the housing having a low profile cover. In another aspect, the antenna also includes a support plate mountable to a wall, ceiling or other mounting surface. In a further aspect, one side of the support plate includes an adhesive backing for mounting the antenna onto a mounting surface.

In another aspect, each major arm of the antenna comprises a log-spiral arm having a first spiral line defined in part by equation (1)

$$r=r_0e^{at}, \qquad \text{Eq. (1);}$$

where r is the radial distance from the origin, a is the expansion rate of the spiral, and $r_0$ is the radius at the origin; and a second spiral line, defined in part by equation (2), $$\begin{cases} x(t) = r_0 e^{at}\cos(\omega t) \\ y(t) = r_0 e^{at}\sin(\omega t) \end{cases} \quad \text{Eq. (2)}$$

where equation (2) is multiplied by a constant $K=e^{-a\theta}$, where ω is the radian speed and θ is the angle with the x axis. In another aspect, "a" has a value of from about 0.4 to about 0.8; 0 has a value of from about 1.0 to about 1.3 (radian); and ω has a value of from about 1.1 to about 1.8 (radian). In a further aspect, "a"=0.59, θ=1.15, ω=1.5 (radian), and the spiral has 1.5 turns.

In another aspect, the antenna does not include a balun.

In another aspect of the invention, a directional antenna comprises the antenna described above disposed in a housing, and further comprises a metal backing plate disposed in proximity to and spaced apart from one side of the housing. In another aspect, the directional antenna also includes an absorber material, wherein the metal backing plate is disposed between the absorber and one side of the housing.

The above summary of the present invention is not intended to describe each illustrated embodiment or every implementation of the present invention. The figures and the detailed description that follows more particularly exemplify these embodiments.

BRIEF DESCRIPTION OF THE DRAWINGS

The present invention will be further described with reference to the accompanying drawings, wherein.

Figure 1:
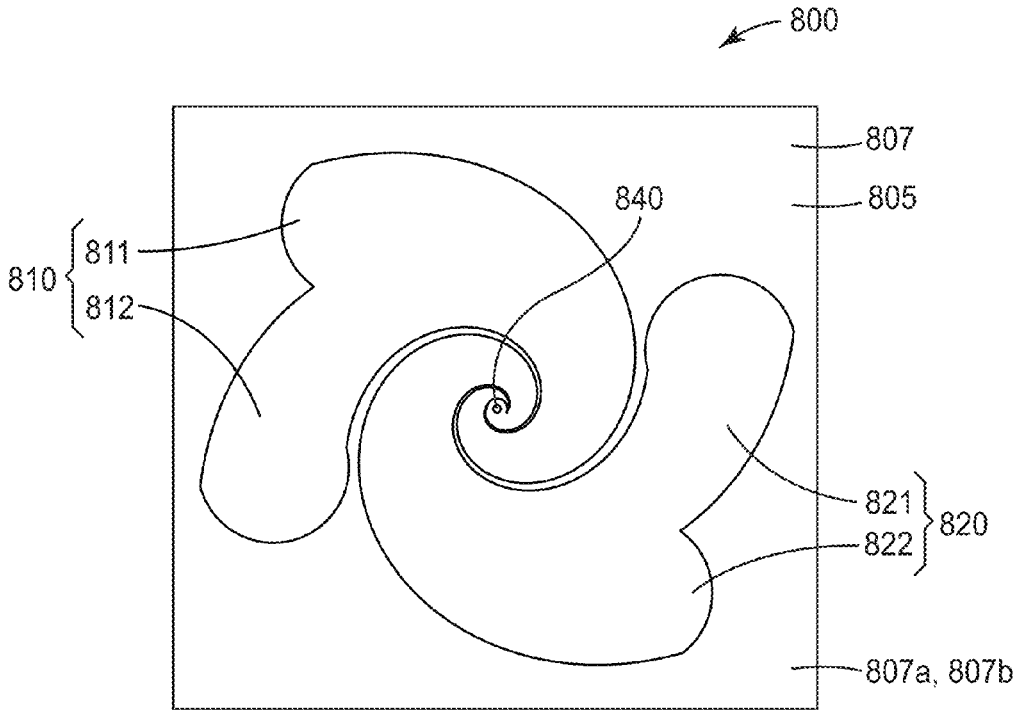
FIG. 1 is a top view of an antenna according to a first aspect of the invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the scope of the invention as defined by the appended claims.

DETAILED DESCRIPTION OF THE EMBODIMENTS

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "forward," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

The present invention is directed to a spiral antenna for use in distributed wireless communications system. In particular, the antenna comprises a log-spiral antenna having two modified log spiral major arms, each major arm comprising two merged primitive or minor smaller arms. In particular, each major arm can be disposed on a different side of a dielectric substrate having a low dielectric constant. The arms have an appropriate area such that the antenna structure is self-complementary. By self-complementary, it is meant that the total surface area of the major arms equals the total surface area of the adjacent dielectric regions. Moreover, the antenna described herein can have a 50 ohm impedance and does not require a balun to provide feed and impedance adaptation, as is customarily the case for conventional self-complementary antennas. In contrast, the antenna feed is provided at the center of the spiral arm structure by a coaxial connector, whereby the center conductor of the coaxial connector is attached to one of the major antenna arms and the shield of the coaxial connector is attached to the other major antenna arm.

As explained herein, in one aspect, the spiral antenna can be part of an adhesive backed wireless transceiver mounted to a wall or a ceiling tile in a structured cabling distribution system for IBW or hybrid network applications. For example, the spiral antenna(s) described herein can provide a single broadband antenna that can support all existing wireless services where coverage and capacity is required within a building. In some aspects, a single antenna can be used for multiple communications networks (e.g., public safety, cellular carriers, and Wi-Fi), whereas in other aspects, one antenna can be used for one service, and another antenna can be used for a different service. In this context, a broadband antenna can have a bandwidth extending from 400 MHz to 6 GHz. Alternatively, the antenna can have a radio frequency bandwidth of a narrower range. Moreover, with the antenna design described herein, the antenna can achieve a return loss better than 10 dB over the entire broadband range. Such a broadband range represents more than four octaves of frequency range.

As explained further below, the antenna can utilize a coaxial cable to attach to the communications system. The antenna(s) described herein can be mounted at many different locations in a building, such as a ceiling location or a wall location. The communications system or network described herein can be implemented as a combined network solution to provide wired in-building telecommunications as well as an in-building wireless (IBW) network. In one aspect, the network can be a modular system which includes a variety of nodes which are interconnected by a ducted horizontal cabling. Alternatively, the antenna may be used in a network that only provides for wireless communications. While the described embodiments mainly involve IBW and hybrid systems, the antenna(s) described herein can be utilized in outdoor applications as well, as would be apparent to one of ordinary skill in the art given the present description.

FIG. 1 shows a first aspect of the present invention, spiral antenna 800. Spiral antenna 800 includes a substrate 805, such as a printed circuit board (PCB). The substrate includes a dielectric material 807 having a first side 807*a* and a second side 807*b*. FIG. 1 shows a transparent substrate so that both sides 807*a*, 807*b* are visible in the figure. In one exemplary aspect, the substrate 805 is a planar substrate, which provides for straightforward operation and manufacturing. In alternative aspects, a non-planar substrate, such as a hemisphere, can be utilized.

Figure 5A:
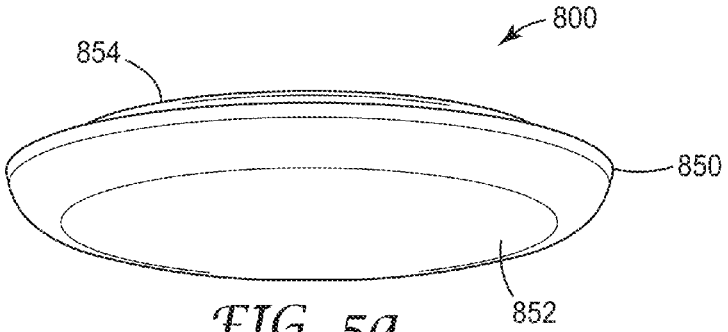
FIGS. 5*a*-5*c* are different views of the antenna housing according to an aspect of the invention.
Figure 5B:
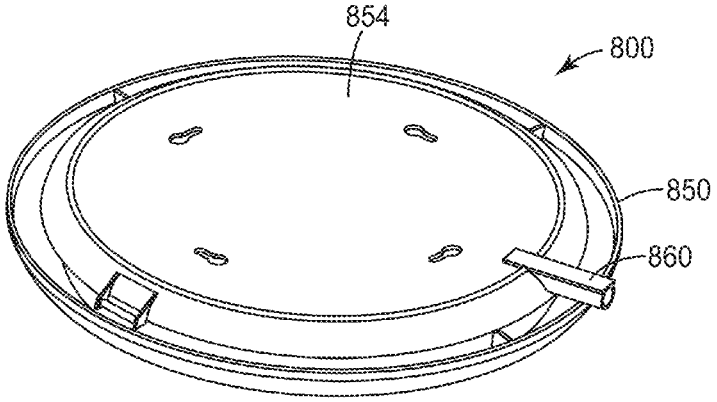
Figure 5C:
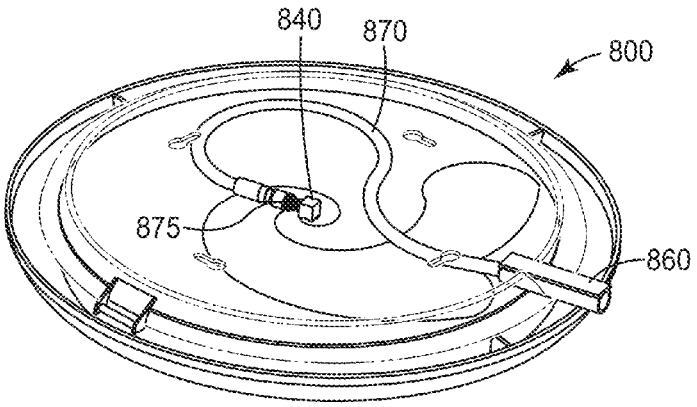

An antenna housing 850 can also be provided, as is shown in further detail in FIGS. 5*a*-5*c*.

Antenna 800 can have a broad radio frequency (RF) bandwidth and a bidirectional radiation pattern. When implemented in a building, a group of antennas 800 can provide the same floor to floor coverage. The antenna can be circularly polarized in some aspects and insensitive to orientation. In an alternative aspect, antenna 800 can be implemented as a directional antenna.

The antenna element includes a first major arm 810 disposed on a first side of the substrate and a second major arm 820 disposed on a second side of the substrate. For purposes of this description, first major arm 810 is disposed on first dielectric side 807*a* and second major arm 820 is disposed on second dielectric side 807*b*. Each major arm 810, 820 has a spiral pattern shape. More particularly, each major arm has a modified log-spiral shape that expands in width from the center of the spiral to the outer edge of the spiral. Also, as shown in FIG. 1, the spiral pattern arms do not overlap, i.e., they are substantially non-overlapping, such that major arm 810 does not overlap second major arm 820. By "substantially non-overlapping" it is meant that a very small portion of the first and second arms may overlap at the center of the spiral in order to provide enough surface area for connection to the connector coupling. The antenna arms can be coupled to a transceiver or network via a connector coupling 840, described in further detail below. In one aspect, the connector coupling is provided at the center of the antenna structure. In this example, the center of the spiral corresponds to the phase center of the antenna structure, where the wave originates.

In some aspects of the invention, the total area of the dielectric material 807 matches the total surface area of the spiral arms 810, 820 of the antenna, thus resulting in antenna 800 being a self-complementary antenna. In one aspect, the dielectric material can be a conventional dielectric material such as found on a printed circuit board (PCB), such as an FR4 PCB.

Each major arm is formed from a metal or other conductive material. In one aspect, the metal can comprise a metal having a high conductivity, such as copper.

In an alternative aspect, a substrate can be omitted. For example, the major arms 810, 820 can be formed as rigid metal structures, e.g., from a metal stamping process. Each arm can be mounted to an inside surface of a housing via posts or other conventional structures so that the arms are spaced apart by about, e.g., 1 mm to about 3 mm, with the same overall log-spiral pattern as described above. The coupling connector 840 can be soldered to each coupling arm. In this configuration, air, which has a dielectric constant of 1, acts as the dielectric material disposed between the major arms.

In order to explain the shape of the arm pattern of the antenna, one can view the first major arm 810 as being formed from a combination or merging of two minor arms (or sub-arms) 811 and 812. Similarly, second major arm 820 is formed from a combination or merging of two minor arms (or sub-arms) 821 and 822.

The specific shape of each major arm and their component minor arms is described in further detail below.

The antenna 800 is a modified logarithmic spiral antenna. Conventional logarithmic spirals antennas, Archimedean spiral antennas, and conical spiral antennas are known and their radiation patterns have been extensively studied. These conventional antenna structures provide a radiation pattern, polarization and input impedance that are nearly independent of frequency or stable with frequency. The frequency independence of such a radiator is with great generality a result of their scale invariance and of being "self-complementary."

Regarding scale invariance, it is understood that if the dimensions of the radiator are multiplied by a factor and the wavelength of operation is multiplied by the same factor, then the radiation pattern, polarization and impedance remains same. This property is known as the Principle of Similitude for Electromagnetic Fields. It is known that if by an arbitrary scaling and or a rotation, a radiating structure is preserved then its properties will be frequency independent. It is also known that a standard log-spiral satisfies this property.

A Self-Complementary Antenna (SCA) can also achieve frequency independence. For a planar antenna structure, a self-complementary structure is achievable when the surface area covered by the metal is equal to the surface area covered by the dielectric material. For a self-complementary structure, it has been shown that the input impedance is $60\pi$ or 188 ohms (Y. Mushiake, *Self-Complementary Antennas* (Springer-Verlag, London, 1996). The SCA condition, by itself, is not however sufficient to provide frequency independence: it only guarantees that the input impedance of the antenna is constant over a broad frequency range. Scale invariance is realizable by a log-spiral antenna design, as well as by a fractal antenna design, for example. However, theoretical scale invariance requires that the antenna be of infinite size. In practice, the size of the antenna will limit the low frequency of operation that can be achieved, and the size of the connector feed structure will limit the upper frequency of operation. In addition, as discussed above, the input impedance of a conventional self-complementary structure is not 50 ohms; accordingly a balun/transformer is conventionally used with SCAs to provide impedance adaption. However, in practice, the design of a balun can be challenging and the bandwidth of the balun may limit the bandwidth of the antenna.

With the antenna 800 shown in FIG. 1, a radiation element being self complementary and having scale invariance is produced. The modified spiral arm arrangement results in an input impedance of 50 ohms, allowing the antenna to be fed by a coaxial cable form an RF connector in a straightforward manner. In this design, a balun is not required to provide impedance adaptation.

One approach that can be used to produce the modified spiral antenna pattern shown in FIG. 1 is described herein in conjunction with FIGS. 2*a*-3*f*.

Figure 2A:
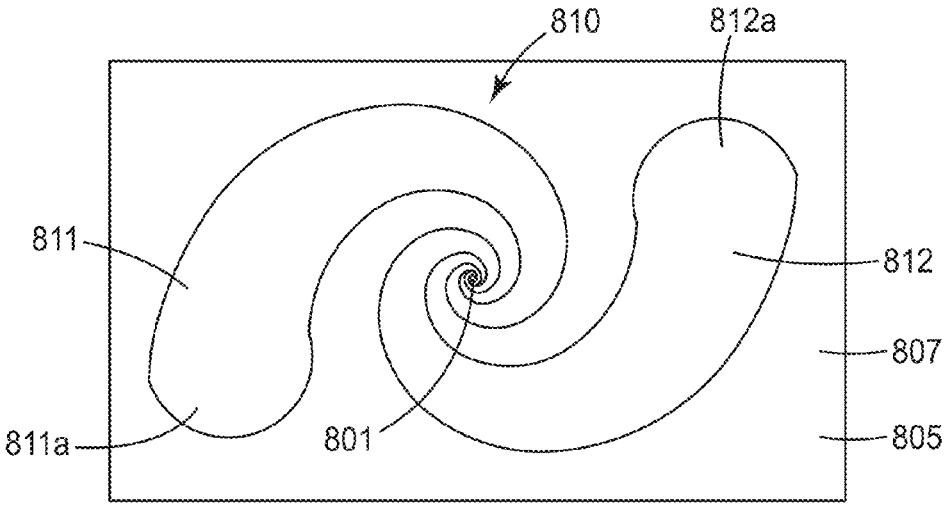
FIG. 2*a* is a top view of a substrate side illustrating the initial position of the minor arms of a first major arm of the antenna according to an aspect of the invention.

FIG. 2*a* shows a so-called initial orientation of major arm 810, with its minor arms 811, 812 in their respective initial positions, in order to clearly illustrate the arm construction. A first major arm 810 (also referred to herein as Arm+) is formed on dielectric side 807*a* from minor arms 811, 812 as follows. Minor arms 811 and 812 are formed as log spirals emanating from center 801. A logarithmic spiral is described by the polar coordinates equation Eq 1:

$$r=r^0e^{at}, \quad \text{Eq. (1);}$$

Where r is radial distance from the origin, a is the expansion rate of the spiral, $r_0$ is the radius at the origin and θ is the angle with the x axis. Eq. 1 can also be written in Cartesian coordinates as:

$$\begin{cases} x(t) = r_0e^{at}\cos(\omega t) \\ y(t) = r_0e^{at}\sin(\omega t) \end{cases} \quad \text{Eq. (2)}$$

In Eq. 2 an additional parameter w, referring to the radian speed is introduced. To build a spiral arm, a second spiral line is drawn by multiplying the Eq. 2 with the constant $K=e^{-a\theta}$. The constants a, θ, ω and the dielectric constant of the substrate are selected so as to achieve an impedance of 50 ohms and a broadband characteristic. In one aspect of the invention, the constant "a" can have a value of from about 0.4 to about 0.8; the constant θ can have a value of from about 1.0 to about 1.3; and the constant ω can have a value of from about 1.1 to about 1.8. In addition, the number of turns in the spiral can be varied. In one particular embodiment, taking in the physical constraints and aesthetics of an implementation in a standard building, a combination of constants a, θ, ω and the number of turns, different set of constants can be selected to produce an impedance of 50 ohms, while maintaining the diameter of the antenna to about 12 inches/0.33 meters or less—in this aspect, a=0.59, θ=1.15 (radian), ω=1.5 (radian), and 1.5 turns, where the diameter of the spiral antenna is about 225 mm.

Using Eq. 1 and Eq. 2, a single arm of the spiral (e.g., minor arm 811) is obtained. The antenna described herein in this example embodiment is a 1.5 turn log-spiral arm, whereby a=0.59, θ=1.15, ω=1.5. The second minor arm (minor arm 812) of major arm 810 is obtained by rotating first minor arm 811 by 180 degrees. The result is two spiral minor arms 811, 812 printed or otherwise formed on surface 807*a*. In an alternative aspect, arms having a greater than 1.5 turn log-spiral shape (e.g., a 2 turn log-spiral shape) could be utilized.

As is evident from the figures, the arms expand in width as they travel from the center of the spiral out towards the edge of the spiral. These arms expand in width at a constant rate.

In addition, each minor arm further includes a semi-circular cap formed on an end thereof. For example, minor arm 811 includes an end cap 811*a* and minor arm 812 includes an end cap 812*a*. The end caps can prevent unwanted reflections.

Figure 2B:
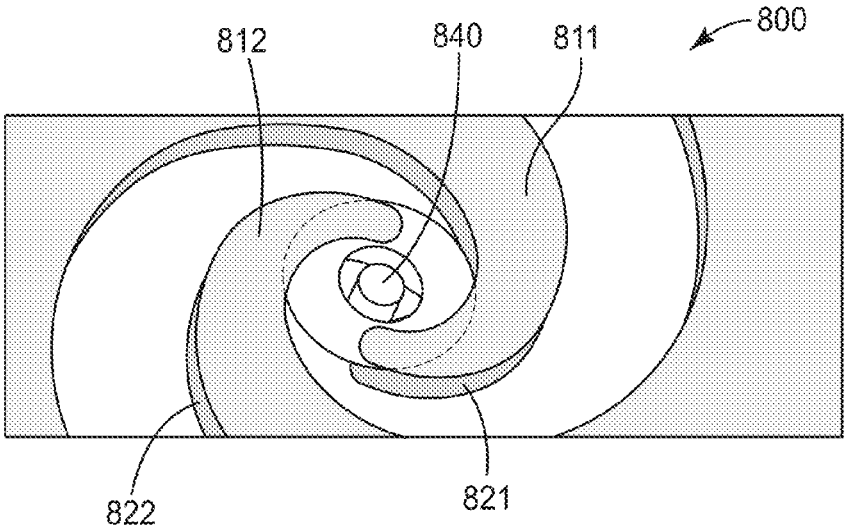
FIG. 2*b* is a close up view of the center of the spiral antenna showing minor arms that overlap in an initial state.

On the bottom side of the substrate/dielectric (e.g., side 807*b*), arms 821 and 822 are configured directly beneath minor arms 811 and 812, respectively. As shown in FIG. 2*b*, for example, minor arm 811 is overlaying minor arm 821 on the opposite side (807*b*) of the substrate and minor arm 812 is overlaying minor arm 822 in a similar manner. Each of the minor arms can further include a semi-circular end cap such as described above. While FIGS. 2*a* and 2*b* do not represent the final structure of antenna 800, they help illustrate the components of the major arms and how the arms are modified from a conventional log spiral shape.

Figure 3A:
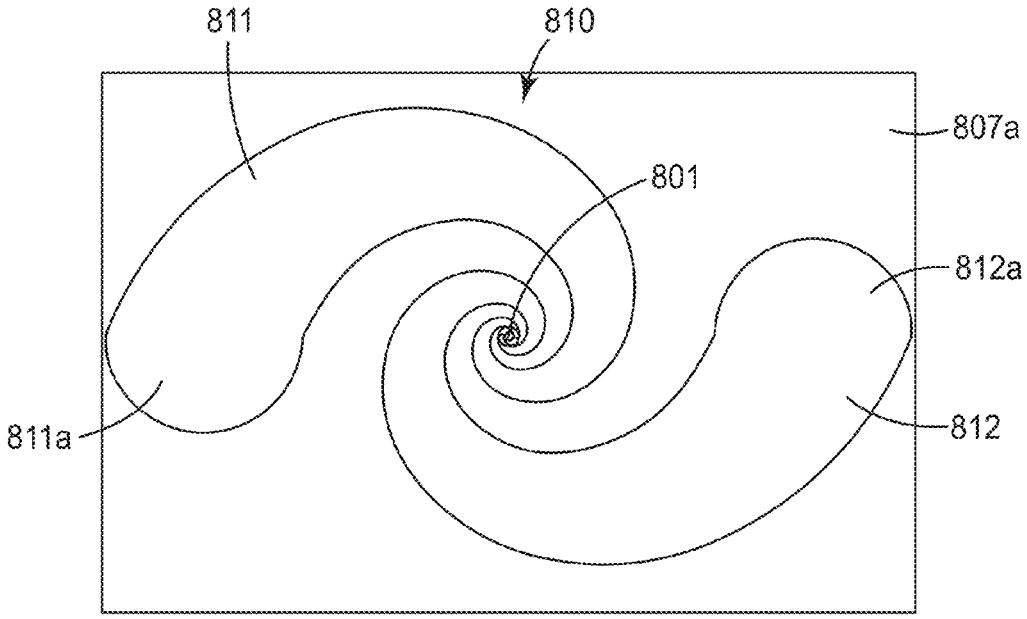
FIGS. 3*a*-3*f* are sequential views of a side of the substrate illustrating the orientation of the minor arms to each other according to an aspect of the invention.
Figure 3B:
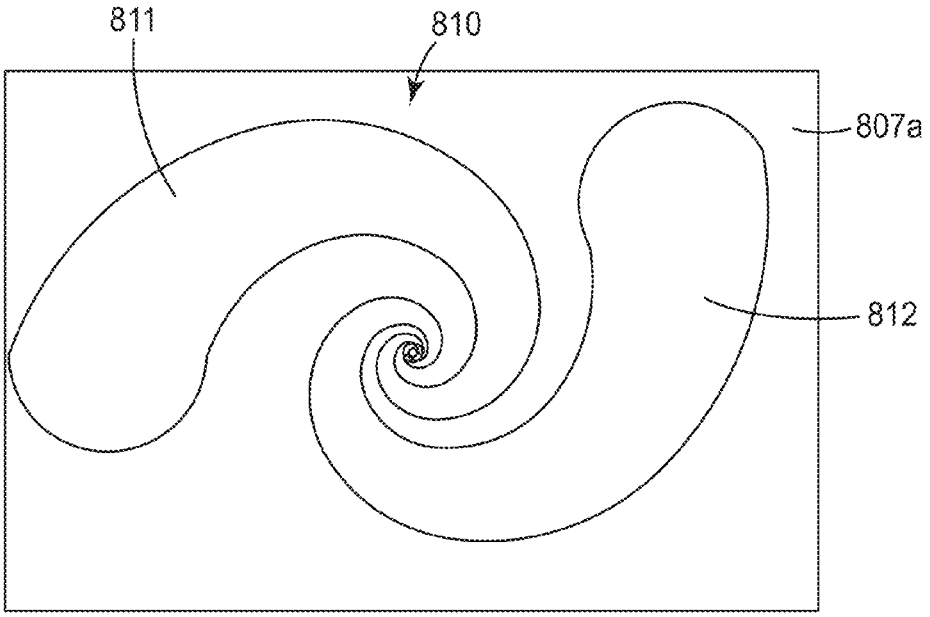
Figure 3C:
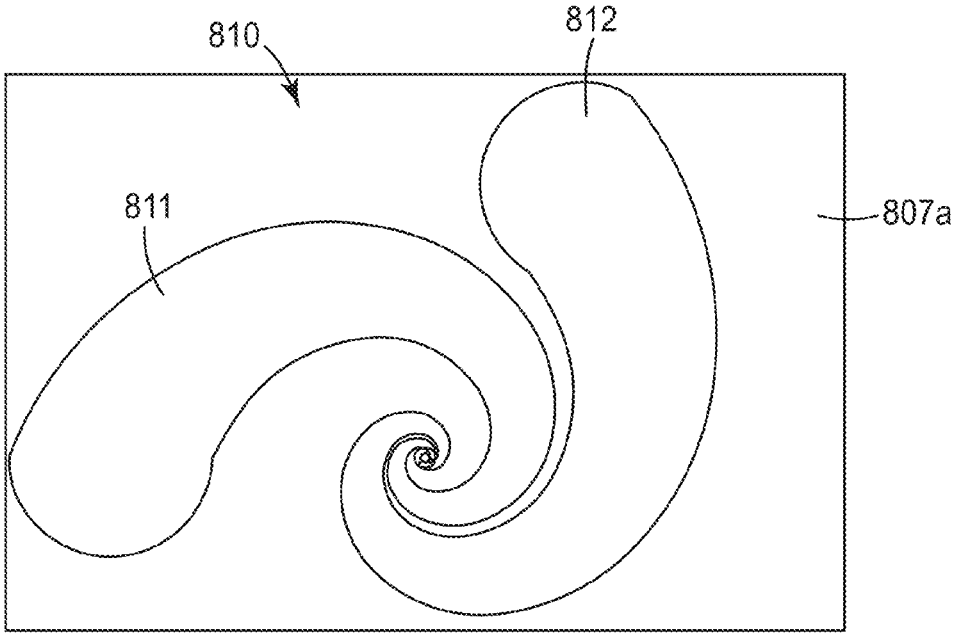
Figure 3D:
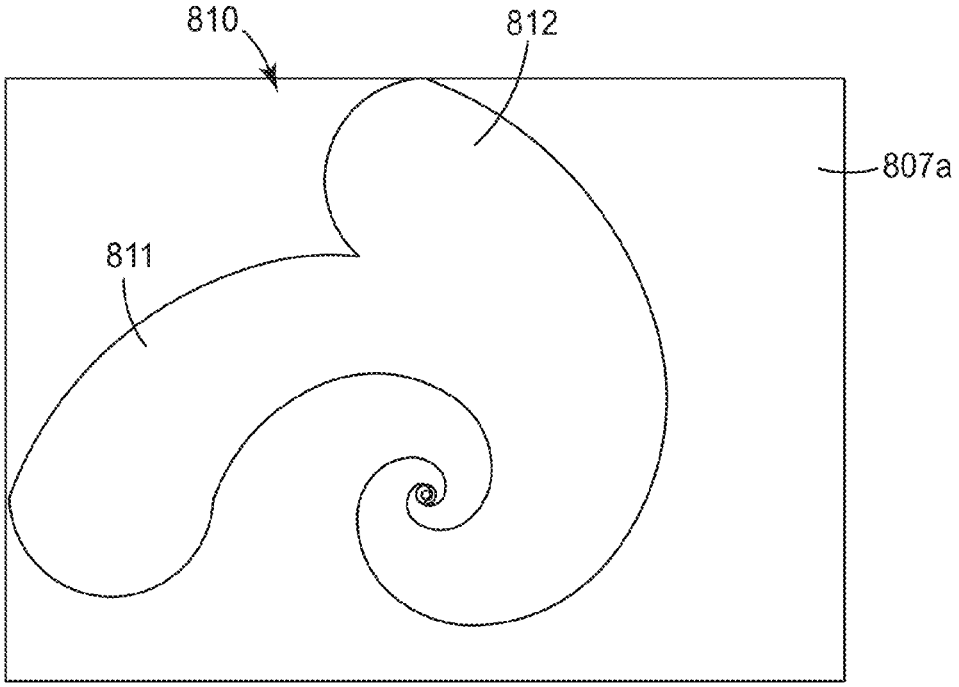
Figure 3E:
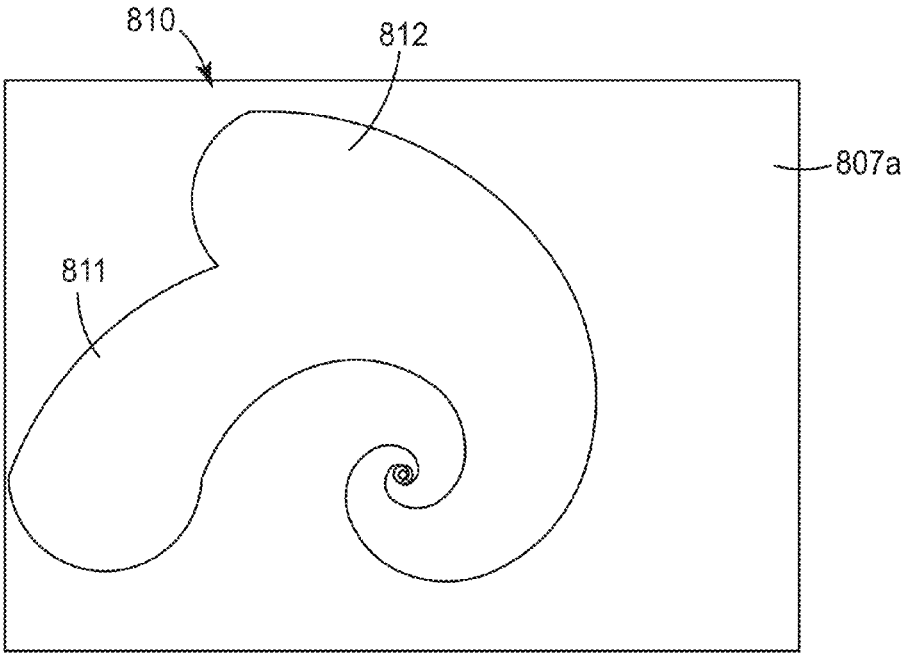
Figure 3F:
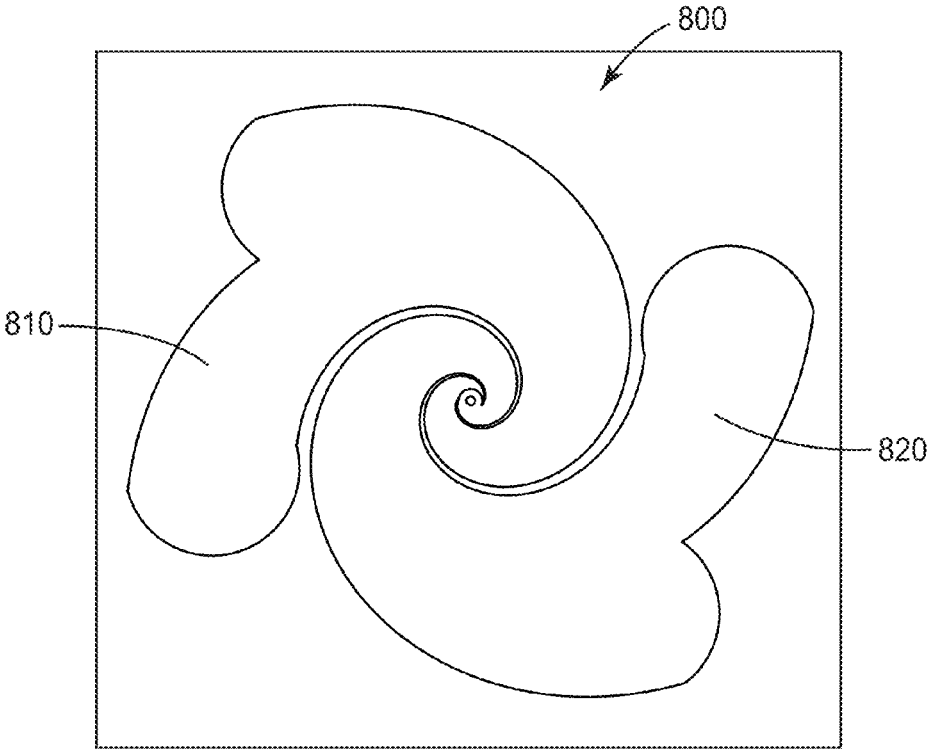

To obtain the final modified log spiral shape, minor arm 811 (side 807*a*) and minor arm 822 (side 807*b*) are held "fixed," and minor arms 812 and 821 are rotated in the same direction, by the same amount. FIG. 3*a* shows the initial stage of side 807*a*, where minor arm 812 is positioned 180 degrees from minor arm 811 and has not yet been rotated (its rotation angle is 0 deg.). In FIG. 3*b*, minor arm 812 is shown rotated by 30 degrees away from its initial 180 degree orientation; in FIG. 3*c*, the rotation angle of minor arm 812 is 60 degrees, in FIG. 3*d*, the rotation angle of minor arm 812 is 90 degrees; and in FIG. 3*e*, the final stage is shown, where the full rotation angle of minor arm 812 is 112 degrees away from its initial 180 degree orientation. In other aspects, this rotation angle can be modified to the point where the top spiral arm 810 and bottom spiral arm 820 just begin to overlap over a substantial portion of their length. However, the antenna structure becomes resonant at some frequencies and may no longer operate as a broadband antenna when there is significant overlap.

Similarly, the same minor arm rotation process is performed on the opposite side 807*b*, where minor arm 812 is held fixed and minor arm 811 is rotated in the same direction by 112 degrees. Thus, if the substrate 805/dielectric 807 were transparent (e.g., air), the antenna arm structure would resemble the structure shown in FIG. 3*f*.

The above antenna structure is circularly polarized and insensitive to orientation. In addition, the frequency response can be tailored depending on the size of the arm structure. For example, the size of the initial radius at the center of the log-spiral pattern can determine the high frequency behavior of the antenna. Additionally, the size/area of the antenna arms determines the low frequency characteristics of antenna 800.

Antenna 800 can be constructed using a conventional lithographic, chemical, or plating process. In some aspects, the manufacturing process can be similar to an additive or subtractive process used in manufacturing PCBs. In another example, the arm structure can be generated by etching away metal from a metal-plated substrate. The etching results in a metal arm pattern, such that each side has a metal arm structure similar to the arm structure described above.

Figure 4A:
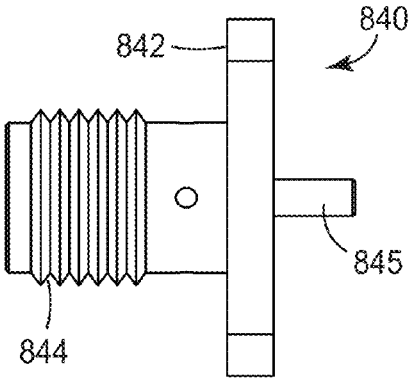
FIGS. 4*a*-4*d* are different views of the coupling connector.
Figure 4B:
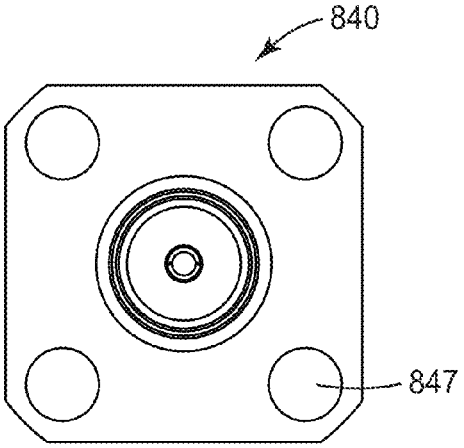
Figure 4C:
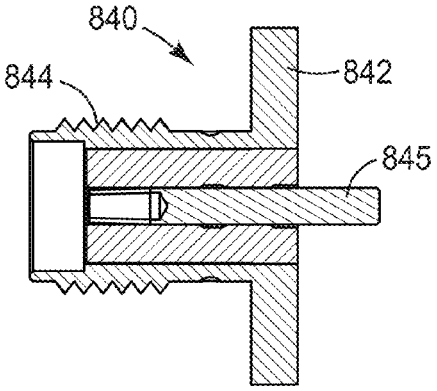
Figure 4D:
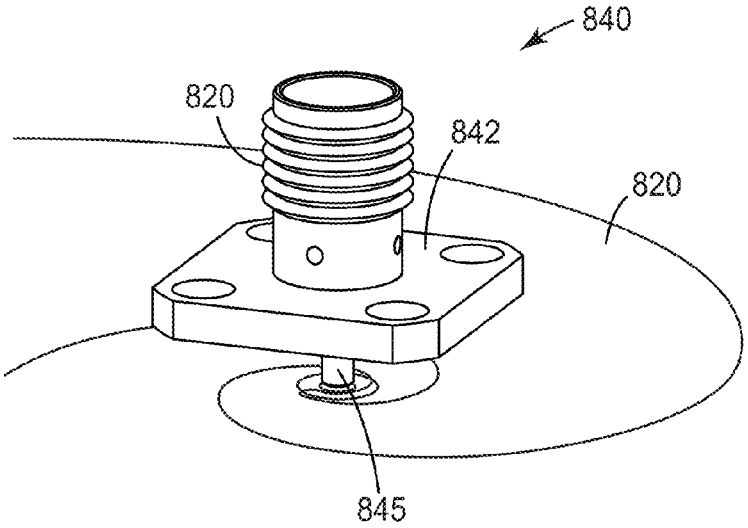

As mentioned previously, antenna 800 further includes a connector coupling 840, shown in more detail in FIGS. 4*a*-4*d*. A side view of the connector coupling 840 is shown in FIG. 4*a*. The front view of connector coupling 840 is shown in FIG. 4*b*. A cross section of connector coupling 840 is shown in FIG. 4*c*. An isometric view of connector coupling 840 coupled to antenna 810 is shown in FIG. 4*d*. In one aspect, connector coupling 840 can comprise a conventional or slightly modified SMA or QMA connector.

In more detail, as shown in FIGS. 4*a* and 4*c*, connector coupling 840 includes a coaxial receptacle 844 to receive a coaxial cable (not shown) having a main body mounting portion 842 that can be soldered or panel mounted onto the first major arm of the spiral antenna. In addition, connector coupling 840 also includes a center pin 845 that is configured to pass through the substrate and connected (e.g., soldered) to the second major arm of the spiral antenna. The center pin can pass through the substrate using a plated hole or via. FIG. 4*b* shows a front view of connector coupling 840, where the main body mounting portion 842 includes one or more mounting holes 847 for mounting the connector coupling 840 to the substrate 805.

FIG. 4*d* shows connector coupling 840 mounted to one side of the antenna. In this example, connector pin 845 is soldered to major arm 820. The other major arm 810 is connected to the main body mounting portion 842 (not shown in the figure for simplicity).

As antenna 800 is designed with a 50 ohm impedance, the antenna may be fed by a standard commercial RF connector, such as a small miniature assembly (SMA). In an alternative aspect for other antenna applications, passive intermodulation distortion may be reduced with a modified connector.

In some aspects, the antenna can be etched on a dielectric laminate. For example, low dielectric constant and low loss laminates such as RT/Duroid 5880 and RT/Duroid 5870 can be used to manufacture the antenna. A suitable substrate can include a material such as FR4, 4350B or 4003C. These are relatively low cost substrates that would not yield a significant degradation of performance. In one experimental example, the investigators tested the performance of a spiral antenna constructed using a RT/Duroid 5880 material, which has a dielectric constant of 2.2. This example yielded acceptable voltage standing wave ratio results.

In other aspects, it may desirable to use a stamping or punching process to blank the spiral arms 810, 820 out of a sheet of metal. The antenna structure can then be assembled with a conventional mechanical process.

As mentioned above, the antenna can be implemented in an IBW network or hybrid network. For example, FIGS. 5*a*-5*c* show various embodiments of antenna 800 with a housing structure 850. The antenna housing structure is a low profile structure that is mountable to a ceiling, wall or other surface via conventional fasteners or adhesives. FIG. 5*a* shows a first view of antenna 800/housing structure 850 as viewed from "beneath" the antenna (when mounted to a ceiling). The bottom cover 852 has a low profile and rounded edges. In this aspect, antenna housing structure 850 has a circular footprint, although rectangular, square or other shapes are also possible. The housing can be constructed from a conventional material such as plastic.

FIG. 5*b* shows a view of antenna 800/housing structure 850 as viewed from "above" the antenna. The housing structure 850 includes a support plate 854 that is generally planar and can be mounted to a mounting surface. In some aspects, the support plate 854 can further include an adhesive backing (not shown). In addition, antenna 800 can also include a cable port or channel 860 to receive a coaxial cable. As shown in FIG. 5*c* (support plate 854 is removed for simplicity), a coaxial cable 870 extends into the housing through channel 860, where a connector end 875 of the coaxial cable 870 is connected to the connector coupling 840. The antenna 800 as shown in FIGS. 5*a*-5*c* can provide a bidirectional radiation pattern.

Figure 6:
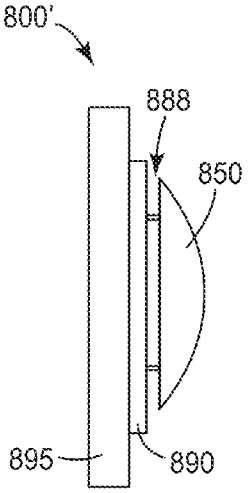
FIG. 6 is a side view of a directional antenna according to another aspect of the invention.

In an alternative aspect, the modified log-spiral antenna described herein can be implemented as a directional antenna. For example, as shown in FIG. 6, antenna 800' can include the antenna arm structure that is housed in a low profile housing structure 850, such as described above. In addition, directional antenna 800' can also include a metal backing plate 890 that is spaced from the housing by a relatively small gap 888 (e.g., about 1"-3"). Conventional posts or other spacing elements can be used to provide a space between the housing structure and the metal backing plate. The metal backing plate 890 directs radiation to and from one direction. Optionally, directional antenna 800' can further include an absorbing material 895 disposed on the opposite side of the metal backing plate. The absorbing material can be a foam like absorber, such as an AB 7000 absorber (available from 3M Company). The absorbing material will absorb the back radiation and improve the front to back ratio of the antenna. Thus, antenna 800' can provide a directional beam and high gain for long hall floor coverage.

Figure 7:
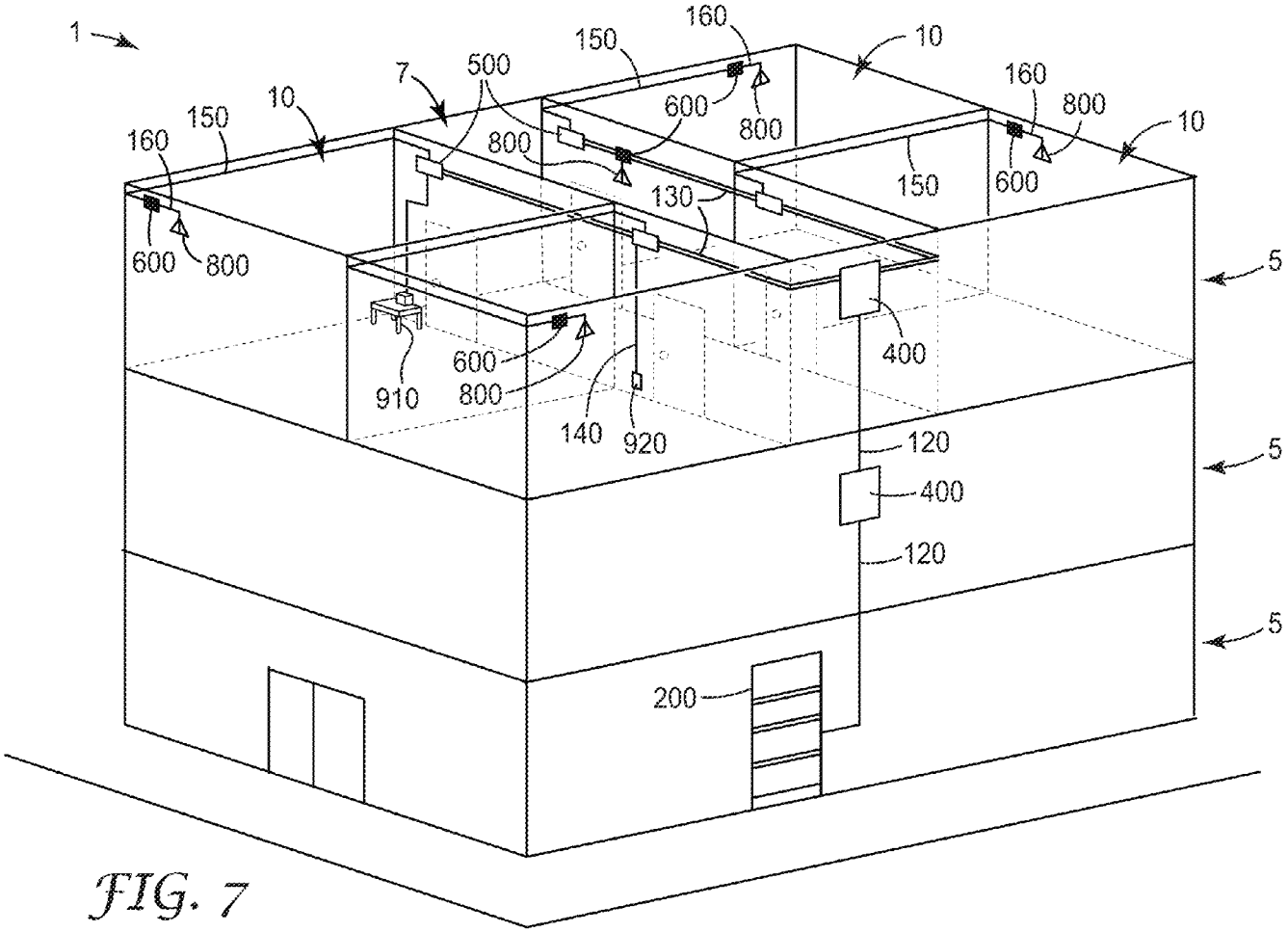
FIG. 7 is an exemplary in-building network implementing the antenna of the present invention.

An implementation of antenna 800 in a hybrid network is described with respect to FIG. 7, which shows an exemplary multi-dwelling unit (MDU) 1 having an exemplary converged network solution installed therein. The MDU includes four living units 10 on each floor 5 within the building with two living units located on either side of a central hallway 7.

A feeder cable (not shown) brings wired communications lines to and from building (e.g. MDU 1) from the traditional communication network and coax feeds bring the RF or wireless signals into the building from nearby wireless towers or base stations. All of the incoming lines (e.g. optical fiber, coax, and traditional copper) are fed into a main distribution facility or main distribution rack 200 in the basement or equipment closet of the MDU. The main distribution rack 200 organizes the signals coming into the building from external networks to the centralized active equipment for the in building converged network. Power mains and backup power can also be distributed through the main distribution rack. Additionally, fiber and power cable management, which supports the converged network, and manages the cables carrying the signals both into the building from the outside plant and onto the rest of the indoor network can be located in the main distribution facility. The main distribution rack(s) 200 can hold one or more equipment chassis as well as telecommunication cable management modules. Exemplary equipment which can be located on the rack in the main distribution facility can include, for example, a plurality of RF signal sources, an RF conditioning drawer, a primary distributed antenna system (DAS) hub, a power distribution equipment, and DAS remote management equipment. Exemplary telecommunication cable management modules can include, for example, a fiber distribution hub, a fiber distribution terminal or a patch panel.

Riser cables or trunk cables 120 run from the main distribution rack 200 in the main distribution facility to the area junction boxes 400 located on each floor 5 of the MDU 1. The area junction box provides the capability to aggregate horizontal fiber runs and optional power cabling on each floor. At the area junction box, trunked cabling is broken out to a number of cabling structures containing optical fibers or other communication cables and/or power cables which are distributed within the MDU by horizontal cabling 130 described above. These cabling structures can utilize the adhesive-backed cabling duct designs described herein. A point of entry box 500 is located in the central hallway at each living unit to split off power and communication cables from the horizontal cabling 130 to be used within the living unit.

A remote socket 600 can be disposed over horizontal cabling 130 in hallway 7 and can be connected to a distributed antenna 800 such as described previously to ensure a strong wireless signal in the hallway.

The cables enter the living unit though a second point of entry box (not shown) within the living unit 10. The point of entry box in the living unit can be similar to point of entry box 500 shown in the hallway 7 in FIG. 1, or it can be smaller because fewer communication lines or cables are typically handled in the second point of entry box in the living unit. The cables entering the living unit through a point of entry box feed remote sockets 600 as well as connections to communication equipment 910 inside of each living unit or a wall receptacle 920 to which a piece of communication equipment can be connected by a fiber jumper.

The optical fibers and power cables which feed the remote socket can be disposed in wireless duct 150. Wireless duct 150 can be adhesively mounted to the wall or ceiling within the MDU. The wireless duct will carry one or more optical fibers and at least two power lines within the duct. Exemplary wireless ducts are described in U.S. Patent Publication Nos. 2009-0324188 and 2010-0243096, incorporated by reference herein in their entirety.

The remote socket 600 can include remote repeater/radio electronics or a wireless access point (WAP) to facilitate a common interface between the active electronics and the structured cabling system. The remote socket facilitates plugging in the remote radio electronics which convert the optical RF to electrical signals and further distributes this to the distributed antennas 800 for radiation of the analog RF electrical signal for the IBW distribution system.

The distributed antennas 800 can be connected to the remote socket 600 by a short length of coaxial cable 160. The antennas are spaced around the building so as to achieve thorough coverage with acceptable signal levels. In one exemplary embodiment, coaxial cable 160 can include an adhesive backing layer to facilitate attachment of the coaxial cable to a wall or ceiling within the MDU. An exemplary adhesive backed coaxial cable is described in U.S. Patent Publication No. 2012-0292076, incorporated by reference herein in its entirety.

Optical drop fibers can be carried from the point of entry box 500 in the hallway to an anchor point within the living unit 10, such as wall receptacle 920 or a piece of communication equipment 910, via telecommunication duct 140. In a preferred aspect, the telecommunication duct 140 is a low profile duct that can be disposed along a wall, ceiling, under carpet, floor, or interior corner of the living unit in an unobtrusive manner, such that the aesthetics of the living unit are minimally impacted. Exemplary low profile ducts are described in U.S. Patent Publication Nos. 2011-0030832 and 2010-0243096, incorporated by reference herein in their entirety.

Experiment

A first sample antenna having a modified log-spiral arm structure similar to that described above was constructed. In particular, first and second major arms formed from copper were patterned on an FR4 substrate. Using the design parameters described above, the resulting antenna had a spiral diameter of 225 mm.

Figure 8:
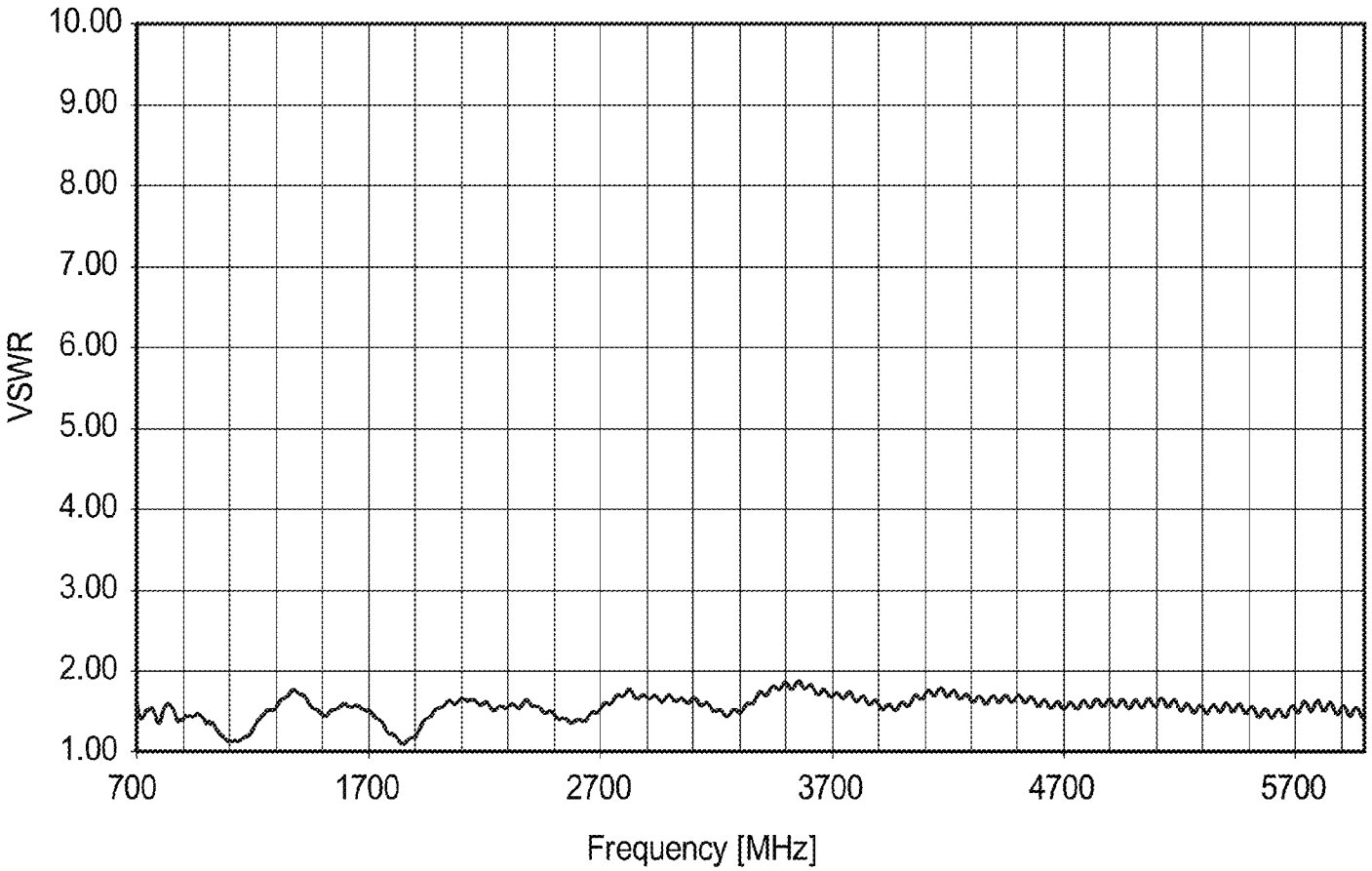
FIG. 8 is a VSWR measurement of an example antenna.
Figure 9A:
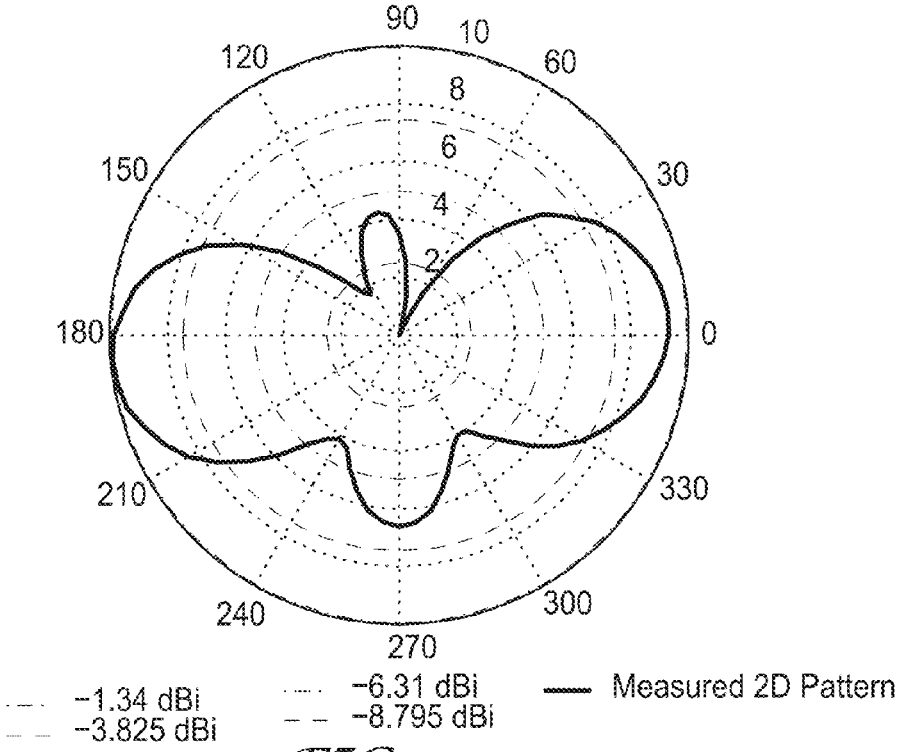
FIGS. 9*a* and 9*b* are radiation pattern measurements for different polarizations of an example antenna.
Figure 9B:
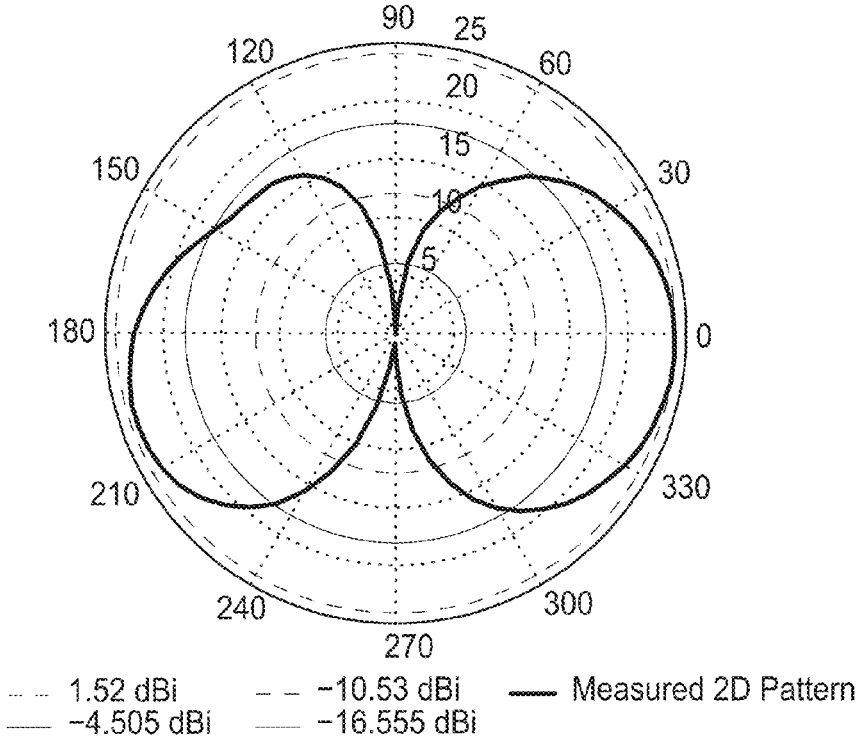

A VSWR (voltage standing wave ratio) measurement of the sample is shown in FIG. 8. This measurement demonstrates better than 2:1 VSWR over a wide frequency range (700 MHz to 5.7 MHz, which is limited only by the instrument response). The radial radiation pattern for the horizontal and vertical polarizations is shown in FIGS. 9*a* and 9*b*.

As is understood, it is desirable to achieve an antenna voltage standing wave ratio of better than or as close possible to 2:1, which signifies that the antenna achieved a good return loss. Additionally, simulations for this antenna structure on FR4 show return loss values of better than −10 dB over a range from 500 MHz to 10 GHz.

Different responses can be obtained by varying the substrate or further modifying the log-spiral pattern consistent with the information provided above.

The antenna of the present invention provides a number of advantages. Antenna 800 has broadband response and can thus be used with a great number of RF technologies. The antenna can be constructed in a straightforward manner. With its 50 ohm impedance, antenna 800 does not require a balun. The antenna can be implemented in a low profile housing with aesthetic appeal as part of an IBW or hybrid network.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the present specification. The claims are intended to cover such modifications and devices.

What is claimed is:

1. A wideband, balun-free antenna for wireless communication, comprising:

a dielectric substrate having a first surface and an opposite second surface;

a first major arm having a first modified log-spiral pattern disposed on the first surface of the dielectric substrate, wherein the first major arm is formed from a combination of first and second minor arms each having a log-spiral pattern shape and each having the same area;

a second major arm having a second modified log-spiral pattern disposed on the second surface of the dielectric substrate, wherein the second major arm is formed from a combination of first and second minor arms each having a log-spiral pattern shape and each having the same area, wherein the first and second major arms are formed from a conductive material, wherein each major arm comprises a log-spiral arm having a first spiral line defined in part by equation (1)

$$r=r_0e^{at} \qquad \text{Eq. (1);}$$

where r is the radial distance from the origin, a is the expansion rate of the spiral, and $r_0$ is the radius at the origin; and a second spiral line, defined in part by equation (2), $$\begin{cases} x(t) = r_0e^{at}\cos(\omega t) \\ y(t) = r_0e^{at}\sin(\omega t) \end{cases} \qquad \text{Eq. (2)}$$

where equation (2) is multiplied by a constant $K=e^{-a\theta}$, where ω is the radian speed and θ is the angle with the x axis;

a coaxial receptacle positioned at a center of the modified log-spiral patterns including having a main body mounting portion mountable to one of major arms and a center pin configured to pass through the dielectric substrate and connect to the other major arm, and wherein the antenna is self-complementary such that a total surface area of the major arms equals a total surface area of adjacent dielectric regions; and wherein the antenna does not include a balun and wherein the antenna has a bandwidth extending from about 400 MHz to about 6 GHz.

2. The antenna of claim 1, wherein the antenna has scale invariance.

3. The antenna of claim 1, wherein each second minor arm is oriented such that it is rotated about 112 degrees from a position 180 degrees from its corresponding first minor arm.

4. The antenna of claim 1, wherein the first and second minor arms each include a semi-circular end cap formed on an end portion thereof.

5. The antenna of claim 1, wherein the antenna has an impedance of 50 ohms.

6. The antenna of claim 1, wherein the first and second major arms are substantially non-overlapping.

7. The antenna of claim 1, further including a housing to support the dielectric substrate, the housing having a low profile cover.

8. The antenna of claim 7, further including a support plate mountable to a wall, ceiling or other mounting surface.

9. The antenna of claim 8, wherein one side of the support plate includes an adhesive backing.

10. The antenna of claim 1, wherein "a" has a value of from about 0.4 to about 0.8; θ has a value of from about 1.0 to about 1.3 (radian); and ω has a value of from about 1.1 to about 1.8 (radian).

11. The antenna of claim 10, wherein a=0.59, θ=1.15, ω=1.5 (radian), and the spiral has 1.5 turns.

12. A directional antenna comprising the antenna of claim 1, wherein the antenna is disposed in a housing, further comprising a metal backing plate disposed in proximity to and spaced apart from one side of the housing.

13. The directional antenna of claim 12, further comprising an absorber material, wherein the metal backing plate is disposed between the absorber and one side of the housing.

14. A wideband, balun-free antenna for wireless communication, comprising:

a first major arm having a first modified log-spiral spiral pattern defining a first plane, wherein the first major arm is formed from a combination of first and second minor arms each having a log-spiral pattern shape and each having the same area;

a second major arm having a second modified log-spiral pattern defining a second plane, wherein the first and second major arms are formed from a conductive material, wherein the second major arm is formed from a combination of first and second minor arms each having a log-spiral pattern shape and each having the same area, wherein each major arm comprises a log-spiral arm having a first spiral line defined in part by equation (1)

$$r=r_0e^{at} \qquad \text{Eq. (1);}$$

where r is the radial distance from the origin, a is the expansion rate of the spiral, and $r_0$ is the radius at the origin; and a second spiral line, defined in part by equation (2), $$\begin{cases} x(t) = r_0e^{at}\cos(\omega t) \\ y(t) = r_0e^{at}\sin(\omega t) \end{cases} \qquad \text{Eq. (2)}$$

where equation (2) is multiplied by a constant $K=e^{-a\theta}$, where ω is the radian speed and θ is the angle with the x axis;

a coaxial receptacle positioned at a center of the modified log-spiral patterns including having a main body mounting portion mountable to one of major arms and a center pin configured to connect to the other major arm, wherein the major arms are spaced by an air gap, and wherein the arms are substantially non-overlapping; and wherein the antenna does not include a balun, has an impedance of 50 ohms and has a bandwidth extending from about 400 MHz to about 6 GHz.

* * * * *